US005311937A

United States Patent [19]

Masaki et al.

[11] Patent Number: 5,311,937

[45] Date of Patent: May 17, 1994

[54] EXTRACTOR FOR AN INJECTION PIPE

[75] Inventors: Tatemi Masaki, Urayasu; Tetsuo Kawahito, Chiba, both of Japan

[73] Assignee: Raito Kogyo Co., Ltd., Tokyo, Japan

[21] Appl. No.: 910,045

[22] Filed: Jul. 8, 1992

[51] Int. Cl.[5] ..... E21B 19/06

[52] U.S. Cl. ..... 166/77; 166/98; 226/162

[58] Field of Search ..... 166/77, 98; 254/29 A, 254/29 R, 30, 31; 81/444

[56] References Cited

U.S. PATENT DOCUMENTS

| | | | |
|---|---|---|---|
| 1,929,055 | 10/1933 | Carr | 254/30 |
| 3,285,485 | 11/1966 | Slator | 166/77 |
| 4,051,988 | 10/1977 | Egerström et al. | 166/77 |
| 4,256,286 | 3/1981 | Hudgins | 254/30 |
| 4,632,183 | 12/1986 | McLeod | 166/77 |
| 4,804,165 | 2/1989 | Pippin et al. | 254/30 |
| 4,890,671 | 1/1990 | Baxter | 254/30 |
| 4,925,159 | 5/1990 | Younes | 254/30 |

FOREIGN PATENT DOCUMENTS

| | | |
|---|---|---|
| 54-31522 | 10/1979 | Japan . |
| 55-38990 | 9/1980 | Japan . |
| 63-44892 | 9/1988 | Japan . |

*Primary Examiner*—Ramon S. Britts
*Assistant Examiner*—Frank S. Tsay
*Attorney, Agent, or Firm*—Lowe, Price, LeBlanc & Becker

[57] ABSTRACT

An apparatus is provided for automatically extracting a grout injection pipe through which grout is injected into fragile ground for improving the same. An extractor for an injection pipe has an extracting main body including a chucking element for chucking the periphery of the injection pipe through a chucking member, a piston cylinder having a rod to which the chucking element is secured, and a rod position detector opposite to the rod of the piston cylinder for detecting movement of the rod. A control device is included for providing an injection pipe chucking and releasing signal to the chucking actuating valve and for providing rod ascending and descending signals to a rod ascending and descending valve. The extracting main body and the control are separately located.

4 Claims, 5 Drawing Sheets

EXTRACTOR FOR AN INJECTION PIPE

DETAILED DESCRIPTION OF THE INVENTION

1. Field of the Invention

The present invention relates to a flexible apparatus for extracting by predetermined lengths for steping-up an injection pipe which has been inserted into the ground.

2. Prior Art

The grout injection methods for injecting grout into the ground in a given range in a depth direction through an injection pipe are mainly classified into an advance type and an extraction (step-up) type methods. The latter type methods are generally used since they are more convenient than the former type methods.

In order to prevent a unmodified zone from occurring by defining accurately the step-up length in the latter step-up type injection methods, extraction of an injection pipe is performed by operating an apparatus for installing an injection pipe while the step up length is measured with a scale or eyes so that the length between the previous position and the position of the currently extracted injection pipe becomes a preset extraction length.

In a method of measuring the extraction length by simple viewing, an unmodified zone may occur. The former method of measuring the extraction length is more preferable.

Measuring the step-up length with a scale by an operator whenever stepup is performed requires much cost and a long period of time.

The present assignee has proposed a flexible injection pipe in Japanese Patent No. 1656824 (Japanese Examined Patent Publication Sho 63-44892) and has made efforts to put it into practical use. Its usability is remarkable. This method using a flexible injection pipe is becoming dominant. The most important advantage of using the flexible injection resides in that insertion and extraction of the injection pipe is possible without using an injection pipe installing machine even if a casing is bent in a hole. This makes it possible to perform injection in a number of sites simultaneously.

Actually measuring the step-up length every time of step-up for simultaneous injection increases the burden upon the operators and the number of operators, which loses the above-mentioned advantage.

On the other hand, an apparatus for merely extracting an injection pipe is known by Japanese Examined Utility Model Publication No. Sho 55-38990, etc. This apparatus does not detect the step-up length, but extracts the pipe by a given stroke of a cylinder.

SUMMARY OF THE INVENTION

It is therefore an object of the invention to achieve a unmanned extraction working and to make an extracting main body light-weight and to make easier the transportion of the extracting main body to the other site after the completion of working at one site in order to cope with simultaneous injection in an number of sites.

In order to accomplish the above-mentioned object, the present invention provide a apparatus for extracting an flexible injection pipe, comprising: an extracting main body including chucking means for chucking the periphery of the injection pipe through a chucking member; a center hole type piston cylinder having a rod to which the chucking means is secured; and a rod position detecting detector opposite to the rod of the center hole type piston cylinder for detecting the movement of the rod, said extracting main body further comprising a chucking actuating valve for actuating said chucking member and an ascending and descending actuating valve for actuating said center hole type piston cylinder; and control means for providing a pipe chucking and releasing signal to the chucking actuating valve and for providing rod ascending and descending signals to the rod ascending and descending valve, the extracting main body and control being separately located.

In this case, the chucking actuating valve for the cylider and an ascending and descending valve for the piston cylinder are provided externally of the extracting main body, for example, in the control.

Automation of chucking is achieved by performing chucking and releasing with the cylinders. Since the rod position detector is provided in a position opposite to the rod, the step-up length is detected from the rod position without operator. Since the signals for chucking and releasing the injection pipe are provided to the chucking actuating valve and the signal for ascending and descending the rod is provided to the ascending and descending actuating valve in response to the signal from the rod position detecting detector, automation of the extraction is achieved. As the piston cylinder of the present invention is of a center hole type, the extractor is very simple in structure and low in cost. Also this center hole type piston cylinder prevents the pipe from breaking at the extractor or from being deflected laterally because the rod guides the flexible pipe.

The control for the automation may be integral with the extracting main body. In case of the above mentioned simultaneous injection in a plurality of sites, in case of injection after the extracting main body has been sequentially moved to next site, and in case of simultaneous injection in a plurality of injection sites each for one extracting main body, the control is made separate from the extracting main body. This prevents the extracting main body from becoming heavy and makes it easier to transport the extracting main body to the other site.

DESCRIPTION OF PREFERRED EMBODIMENTS

The present invention will now be described by way of preferred embodiments with reference to drawings.

Figure 3:
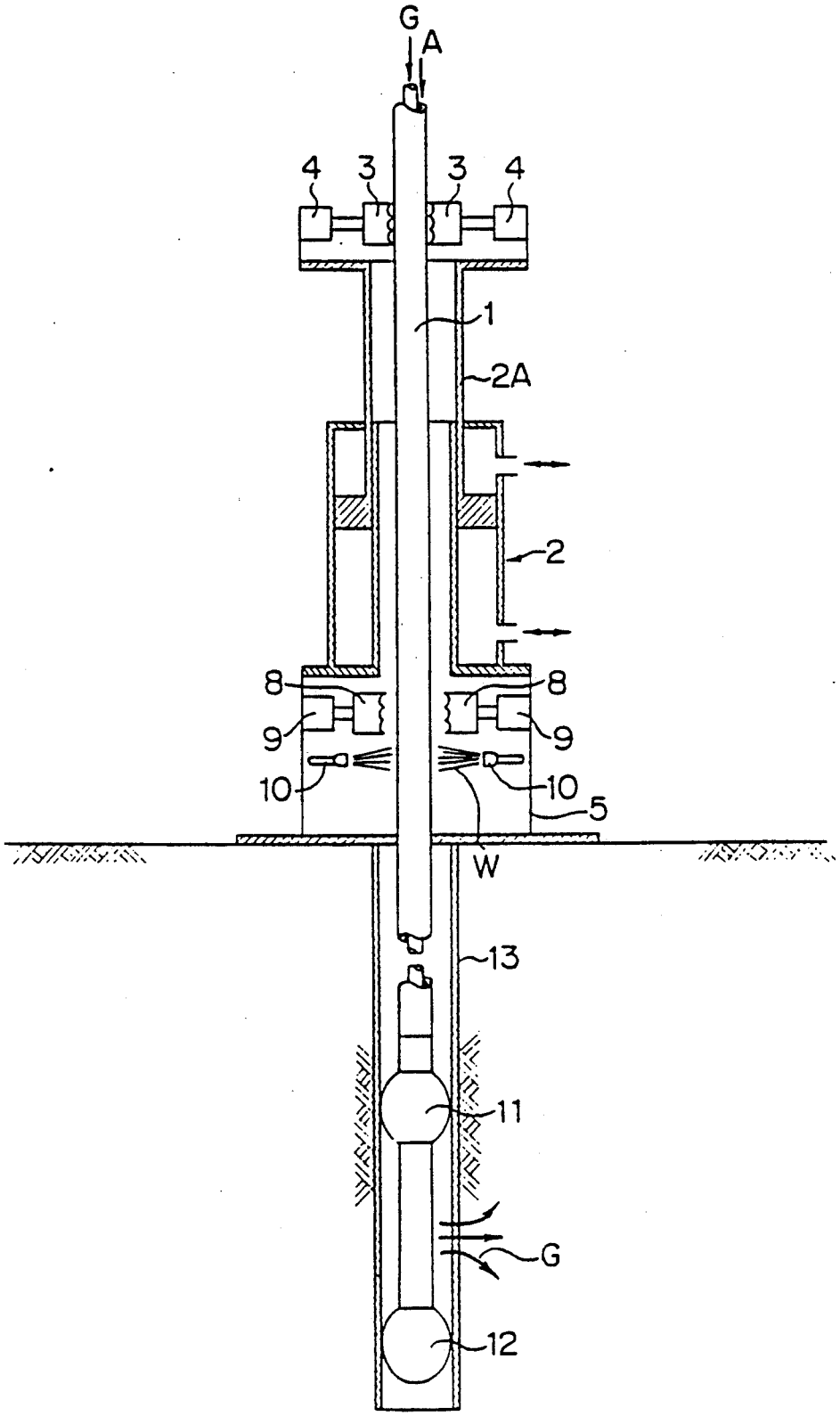
FIG. 3 is a schematic sectional view showing the entire of an extracting main body.

FIG. 3 is a schematic view showing an extracting main body. A center hole type piston cylinder 2 which surrounds an injection pipe 1 is provided. Upper chuck cylinders 4 which chuck the periphery of the injection pipe 1 at the tip end of a rod A via an upper chucking member 3 are provided in an opposing manner.

Figure 5:
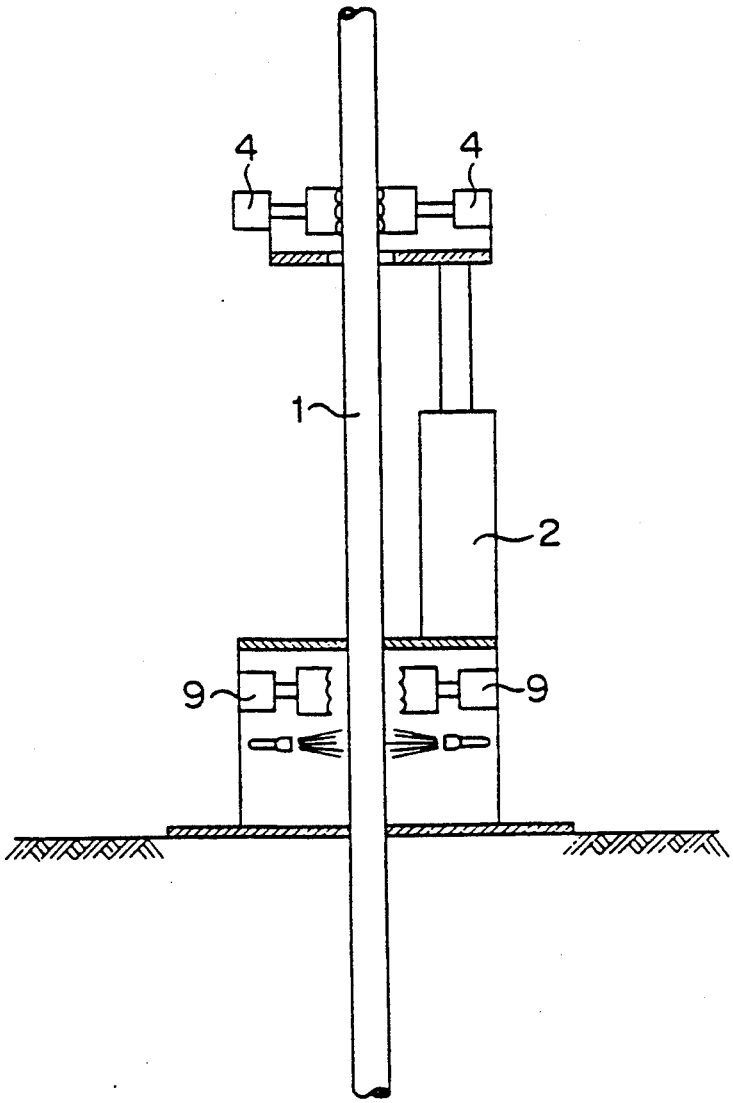
FIG. 5 is a schematic longitudinal sectional view showing another embodiment.

The piston cylinder 2 is firmly secured to a stand 5 and transportation wheels 6 are provided on one side of the stand 5 as shown in FIG. 5 in detail. An annular transportion handle 7 is firmly secured to the upper portion of the piston cylinder 2. In order to move the extracting main body, operator holds the handle 7 in such a manner that the main body is tilted and is supported on the wheels 6. The main body can be easily moved by rolling the wheels 6 to the other injection site. Since the weight of the extracting main body is about 40 kg, its transportation is easy.

Although the injection pipe 1 is chucked in a position along the length of the pipe 10, lower chuck cylinders 9 which chuck the lower portion of the piston cylinder 2 upon the stand 5 through a lower chucking member 8 are provided in an opposing manner for stably chucking and moving the injection pipe 1. A nozzle 10 for washing mud and the like disposed on the injection pipe 1 are provided below the lower chuck cylinders 9 in an opposing manner if necessary. The nozzles 10 inject washing water upon the outer surface of the injection pipe 1 to wash out the mud thereon while the injection pipe 1 is extracted.

The injection pipe 1 has packers 11 and 12 on the upper and lower portions thereof in the vicinity of the lower end, respectively. Injection of grout G is performed while the packers 11 and 12 are inflated with pressurized air A supplied through the pipe 1 so that the packer 11 and 12 are closely contact with the inner wall of a casing pipe 13. The injection pipe 1 may be that disclosed in the above mentioned Japanese Examined Patent Publication Tokko Sho 63-44982.

Figure 1:
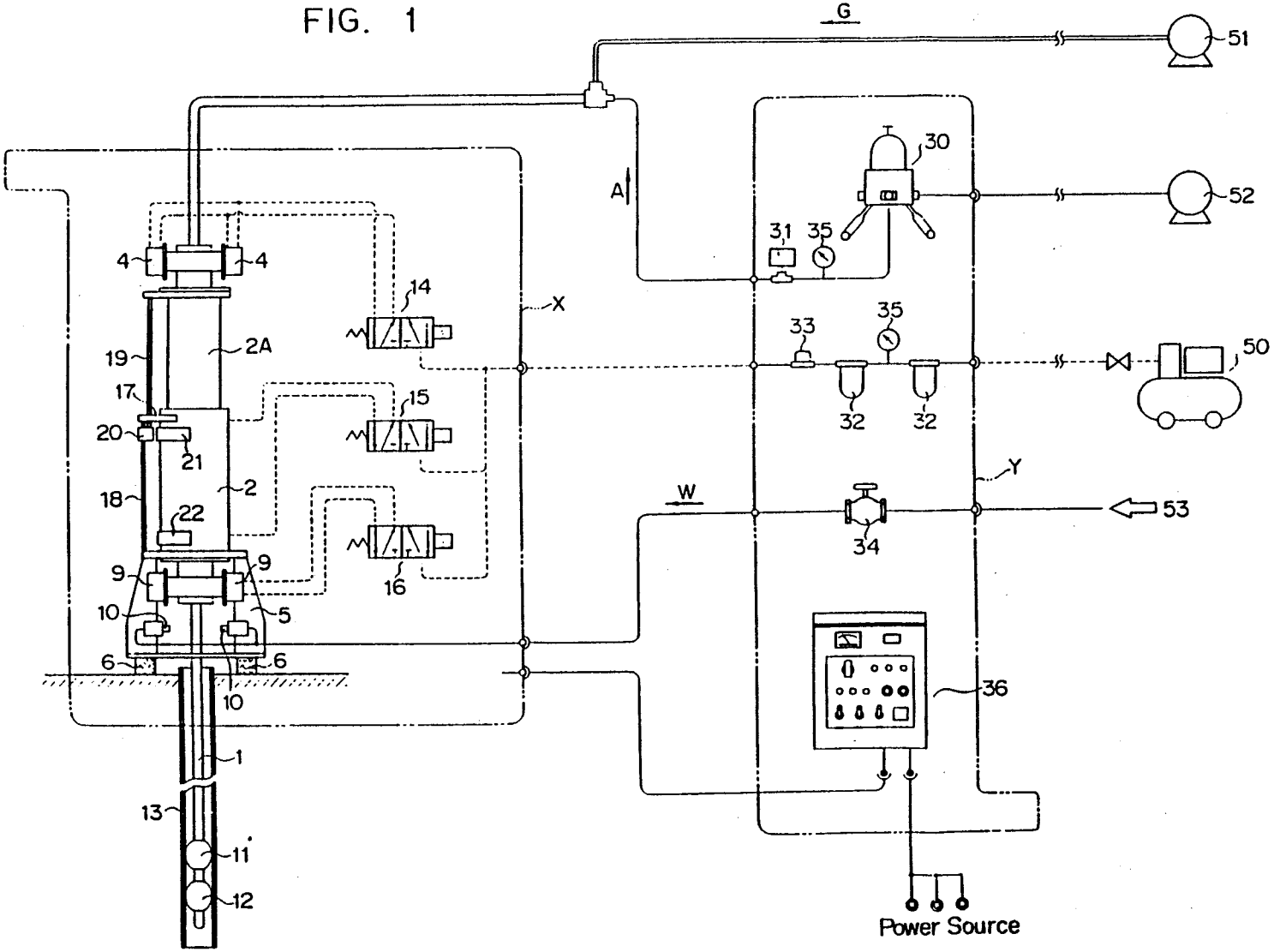
FIG. 1 is view showing the entire of an embodiment of the present invention.
Figure 4:
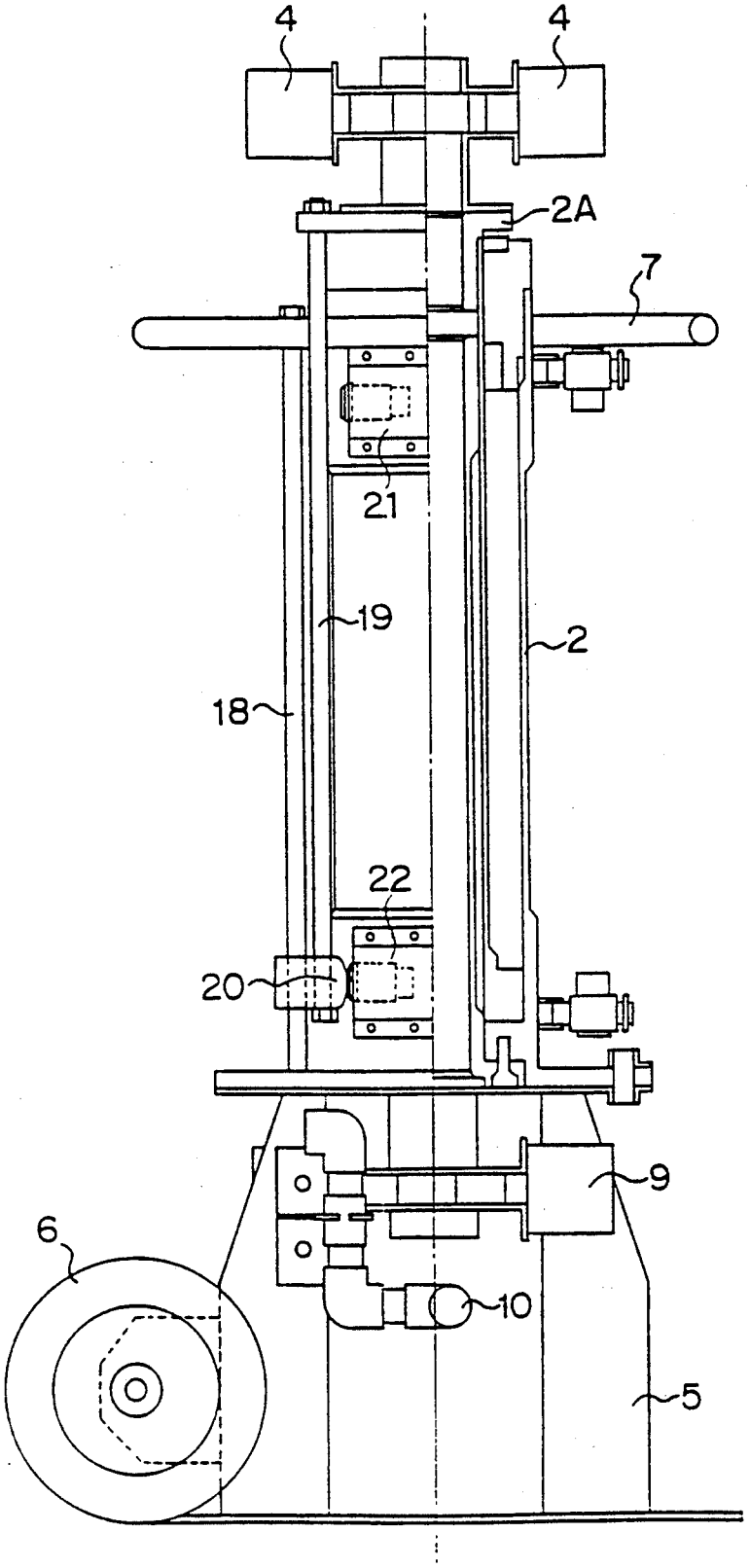
FIG. 4 is a half sectional and a half elevational view showing the detail of the extracting main body.

Referring now to FIG. 1, the upper chuck cylinders 4, the piston cylinder 2 and the lower chuck cylinders 9 are coupled with a common pressure source such as an air compressor 50 via four-direction solenoid valve 14, 15 and 16, repectively since they are pneumatically driven in this embodiment. The four-direction solenoid valves 14, 15 and 16 are secured to the stand 5 (refer to FIG. 4). A guide rod 18 is secured to the cylinder 2 at the upper end thereof and is secured to the upper end of the stand 5 stradding a bracket 17 as shown in FIG. 1. A moving rod 19 which is secured to the upper end of the rod 2A extends downward through the bracket 17 and has a metal piece 20 at the lower end thereof. The metal piece 20 is loosely fitted to the guide rod 18. Upper and lower proximity switches 21 and 22 for detecting the position of the rod are secured to the upper and lower portions of the piston cylinder 2, respectively. The length between these proximity switches 21 and 22 is preliminarily preset to a given step-up length, for example, 33 cm. If necessary, the preset step-up length may be changed by changing the mounting position of at least one of the proximity switches 21 and 22 or by providing a mounting position variable structure in which at least one of the proximity switches is movable in a vertical direction.

In such a manner, a unit X of FIG. 1 is formed as the extracting main body.

An extraction control Y is provided separately from the extracting main body X.

The air compressor 50, a grout pressuring pump 51, a packer operating pump 52 and a washing water source 53 are provided in addition to these units X and Y.

The extraction control Y comprises a packer inflation and deflation switch 30, a pressure switch 31, filters 32 for cylinder actuating air, a pressure filter 33, a washing water supply turning on or off solenoid valve 34, a pressure gauge 35 and a main unit 36 of the control having a capability of providing signals for chucking and releasing the injection pipe 1 to the chucking operating valves 14 and 16 and signals for ascending and descending the rod 2A to the ascending and descending actuation valve 15 in response to position detection signals from rod position detectors 21 and 22.

When the injection pipe 1 is to be extracted, the thus formed extracting apparatus deflates the packers 11 and 12 by stopping an injection pump 51 and positions the rod 2A at the lower extremity and then actuates the solenoid valves 14 and 16 for extending the rod of the chuck cylinder 4 and for retracting the rod of the chuck cylinder 9 so that chucking and releasing of the injection pipe 1 is performed by the chucking members 3 and 8, respectively. Then, the piston cylinder 2 is actuated under this condition through the solenoid valve 15 for extending the rod 2A. The moving rod 19 and the metal piece 20 are also ascended in association with this extension of the rod 2A. The moving rod 19 and the metal piece 20 are also ascended in association with this extension of the rod 2A. When the metal piece 20 reaches the position facing to the upper limit proximity switch 21 by this ascending, the upper limit proximity switch 21 is actuated. A fact that the rod 2A has reached the upper limit and is thus stepped-up by a given length is detected.

When the stepping-up has been detected in such a manner, the packers 11 and 12 are inflated in this position and then grout G is injected. At this injection, chucking of the injection pipe 1 is conducted with the chucking member 8 for stabilization of the injection pipe 1. If inflation of the packers 11 and 12 is completed, it is preferable to lower the rod 2A at the appropriate time for the preparation of the next step-up.

If lowering of the rod 2A is detected by the detection of the metal piece 20 with the proximity switch 22 and injection of grout at this stage is completed, steppin-up is performed as mentieond above to shift to the next upper stage.

The lower chucking means may be omitted in the present invention.

Although the detector for detecting the position of the rod 2A comprises the proximity switch in the foregoing embodiment, the detector may be an optical detector for optically detecting a mark on the rod 2A. The piston cylinder may be of the type in which a piston cylinder is arranged in parallel with the injection pipe 1 (as shown in FIG. 5).

Figure 2:
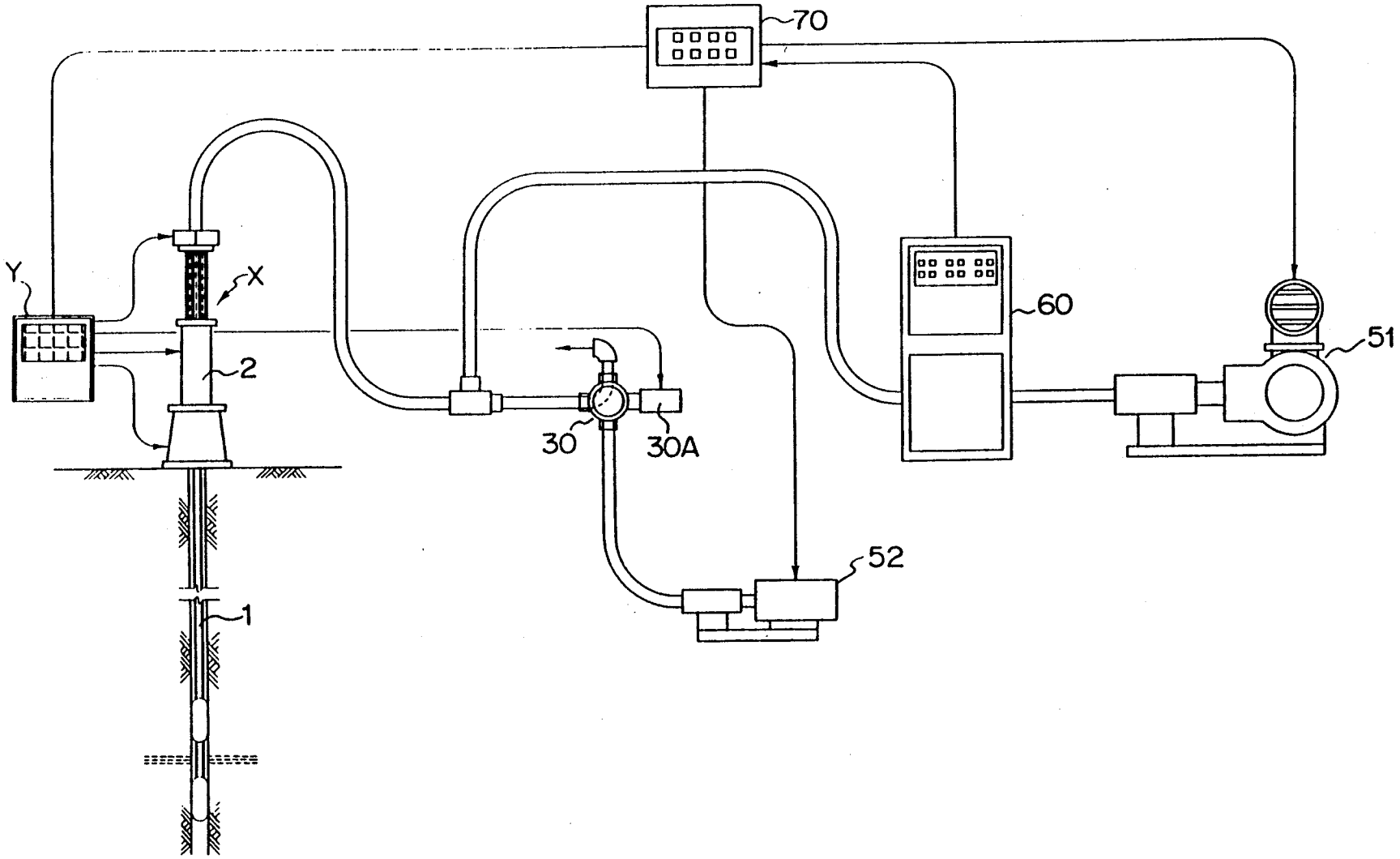
FIG. 2 is a view showing the entire of an embodiment which is combined with an extraction managing apparatus.

FIG. 2 is a schematic view showing a combination of the extracting main body with an injection management apparatus.

In addition to the extraction control Y of the present invention, an electromagnetic flow rate meter 60 and an automatic injection control 70 are provided. The amount of the grout to be injected at each stage is preliminarily preset in the automatic injection control 70 and stops the operation of a grout pressurizing pump 51 when the amount of the injected grout detected by the electromagnetic flow rate meter 60 reaches the preset injection amount. The control 70 applies starting and stopping signals to the packer inflating pump 52 and an extraction operating signal to the extraction control Y. Conversely, the extraction control Y applies an operating signal to the extracting main body X in response to the signal from the automatic extration control 70. A series of injection steps are carried out as follows:

(1) The extracting main body is placed in a desired site. The electromagnetic flow rate meter 60 is reset to zero. A switching cylinder 30A for the packer inflating and deflating switch 30 is actuated to inflate the packers 11 and 12 for completing the preparation.

(2) Then, the operation of the grout pressuring pump 51 is started under this condition. The solenoid flow rate meter 60 outputs a flow rate signal while the grout is injected.

(3) The operation of the grout pressurizing pump 51 is stopped at the time when the flow rate signal represents that the injection amount reaches a given preset injection amount.

(4) The packers 11 and 12 are evacuated to deflate by actuating the switching cylinder 30A of the deflation switch 30.

(5) The injection pipe 1 is lifted by a given distance by extending the rod 2A of the piston cylinder 2 to shift to next upper stage.

(6) The electromagnetic flow rate meter is automatically reset to zero and the packers 11 and 12 are inflated to compete the preparation for the upper stage.

(7) The operation of the grout pressurizing pump 51 is started again under this condition for injecting the grout to the upper stage.

(8) The switching cylinder 30 of the deflation switch 30 is actuated to deflate the packers 11 and 12.

(9) Returning to the step (2), subsequent steps are repeated.

(10) Such an operation is performed at each stage. When the number of the stages becomes the preset number of stages, automatic injection operation is terminated.

(11) Then, the injection pipe 1 is automatically extracted at preset times under a condition in which the packers 11 and 12 are deflated and the operation of the grout pressurizing pump 51 is stopped.

As mentioned above, the present invention provides advantages in that extracting work can be performed without operator, the extracting main body can be made light in weight and can be easily transported to any desired position for simultaneous multi-site injection.

In this disclosure, there are shown and described only the preferred embodiments of the invention, but, as aforementioned, it is to be understood that the invention is capable of use in various other combinations and environments and is capable of changes or modifications within the scope of the inventive concept as expressed herein.

What is claimed is:

1. An extractor for a flexible pipe, comprising:

an extracting main body including a single chucking means for chucking the periphery of the flexible pipe through a single chucking member, a center hole type piston cylinder having a rod to which the chucking means is secured, and a rod position detecting means opposite to the rod of said center hole type piston cylinder for detecting a movement of the rod, said extracting main body further comprising a chucking actuating valve for actuating said chucking member and an ascending and descending actuating valve for actuating said center hole type piston cylinder; and control means for providing a pipe chucking and releasing signal to said chucking actuating valve and for providing rod ascending and descending signals to said rod ascending and descending valve, said extracting main body and control means being separately located.

2. The extractor for a flexible pipe according to claim 1, wherein:

said extracting main body comprises means for cleaning an outer surface of the flexible pipe by injecting washing water thereon.

3. The extractor for a flexible pipe according to claim 1, further comprising:

flow rate measuring means, disposed in a passage leading from a grout supply to the flexible pipe, for providing a signal relating to a grout injection flow rate to the control means to enable the control means to control extraction of the flexible pipe.

4. The extractor for a flexible pipe according to claim 1, further comprising:

inflatable packer means disposed adjacent a lower end of the flexible pipe.

* * * * *